United States Patent [19]

Carson

[11] Patent Number: 4,573,420

[45] Date of Patent: Mar. 4, 1986

[54] APPARATUS FOR PRODUCING SIMULATED FELLED SEAM

[76] Inventor: Charles F. Carson, 2503 Lakeshore Dr., Greensboro, N.C. 27407

[21] Appl. No.: 713,181

[22] Filed: Mar. 18, 1985

[51] Int. Cl.[4] ..... D05B 35/02

[52] U.S. Cl. ..... 112/142; 112/147

[58] Field of Search ..... 112/142, 147, 143, 141, 112/136; 2/275

[56] References Cited

U.S. PATENT DOCUMENTS

| | | | |
|---|---|---|---|
| 2,096,330 | 10/1937 | Le Vesconte | 112/147 |
| 2,169,590 | 8/1939 | Myers | 112/425 |
| 3,121,412 | 2/1964 | Greco | 112/147 X R |
| 4,395,963 | 8/1983 | Diacont, Jr. et al. | 12/142 X R |
| 4,476,792 | 10/1984 | Diacont, Jr. et al. | 112/142 |

*Primary Examiner*—H. Hampton Hunter

*Attorney, Agent, or Firm*—Charles R. Rhodes; Judith E. Garmon

[57] ABSTRACT

A pair of fabric members having proximate abutting margins preliminarily united by a row of basting stitches are then fed through a folder device and folded into a three-ply, Z- or S-shaped construction in preparation for a finished seaming operation. As the members pass through the folder device one of the fabric members is folded along a line on one side of the row of basting stitches to underlie the united margins and the other of the fabric members is reverse folded along a line on the other side of the row of basting stitches to overlie the united margins. The aforesaid folder includes a base plate having an upstanding guide rib or scroll and a generally horizontal guide plate. The guide plate is spaced above the base plate and includes a longitudinal edge forming the line about which the one fabric member is folded to underlie the united margins. The guide rib includes an upper edge which, in the upstream portion of the base plate, is curved in a convoluted path to guide the united margins and overlying fabric member up and around the edge of the guide plate, and in the downstream portion of the base plate then forms the edge about which the overlying fabric member is reverse folded to overlie the united margins.

6 Claims, 13 Drawing Figures

FIG. 6A
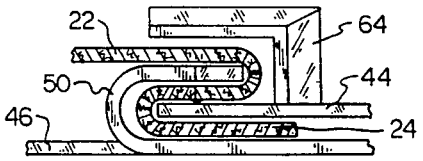
FIG. 6B
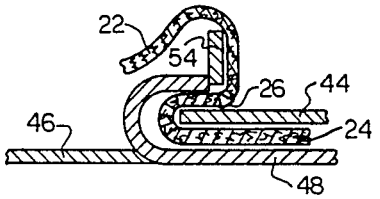
FIG. 6C
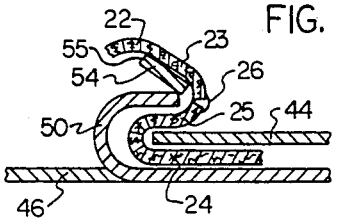
FIG. 6D
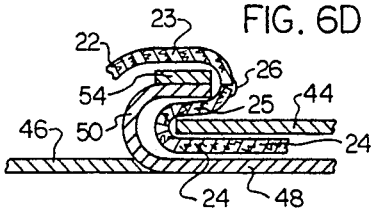
FIG. 6E
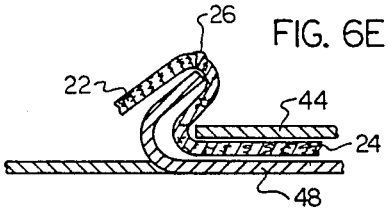
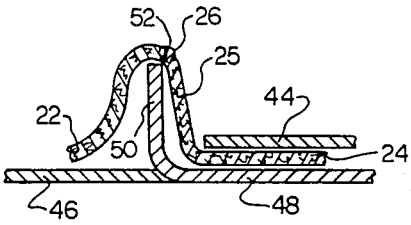
FIG. 6F
FIG. 6G
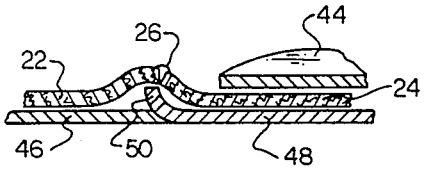

APPARATUS FOR PRODUCING SIMULATED FELLED SEAM

BACKGROUND AND SUMMARY OF THE PRESENT INVENTION

The present invention relates generally to an apparatus and method for making simulated felled or lap seams, and more particularly to the apparatus for folding the material to form such simulated felled or lap seam.

In the garment industry, as well as in other fabric sewing operations, it is quite often customary to join adjacent overlapped edges of two fabric members in what is referred to as a "felled," "felled," or "lap" seam. An example of such seams is best illustrated by reference to the side seams in the legs of jeans. The terms "felled," "felled," or "lap" seams is understood to refer to seams in which proximate marginal portions of adjacent fabric members are first overlapped, then the upper one of the fabric members is folded around the edge of the lower fabric member to underlie the overlapped margins and the lower of the fabric members is folded around the edge of the upper fabric member to overlie the overlapped margins. This results in a four-ply seam which is subsequently seamed by zig-zag stitches or, more conventionally, by a pair of parallel longitudinal row of stitches.

Various apparatuses have been developed for processing overlapped fabric members through a folding station to prepare the felled seam for the stitching operation. Examples of such apparatuses are illustrated in U.S. Pat. Nos. 2,096,330 to Le Vesconte and 4,476,792 to Diacont, have become conventional in the sewing industry. While such seams result in an extremely strong fabric joint, several attendant problems have appeared. For example, the four-ply construction obviously requires additional material to form the two overlapping proximate marginal portions. This additional material is both costly and makes the garment seams more bulky than necessary. Such bulky seams tend to ripple when washed.

A preferable type of seam to use as a replacement for conventional felled seams is the "simulated felled seam" in which the proximate margins of two adjacent fabric members are abutted, rather than overlapped, preliminarily united by a row of basting stitches and then folded into a three-ply construction. In this approach, after the preliminary butt seam is formed, one of the fabric members is folded along an imaginary line on one side of the row of basting stitches to underline the united margins and the other of the fabric members is reverse folded along an imaginary line on the other side of the row of basting stitches to overlie the united margins. An example of this type of seam is illustrated and described in U.S. Pat. No. 2,169,590 to Myers (see FIGS. 3, 4, and 7). Such construction eliminates one of the plies which both saves material and thus expense, and looks better. Further, there is no apparent loss of strength in such a seam. One drawback to date of such a type of seam is that there is no automated equipment for forming such a seam. It is believed that one reason why no such equipment is presently available is perhaps twofold. The first reason is because of the problem attendant to maintaining the preliminary butt seam formed by the abutting edges of the two fabric members consistently in the center of the resulting folded seam.

Secondly, it is difficult to keep an accurate, small amount of turn-under in a folder.

It is this problem which has been confronted and solved in the present invention. In general then, the present invention is directed to an apparatus and method for forming such simulated felled seams automatically and in such a manner as to maintain the abutting edges of the two fabric members centrally located between the parallel row of finish stitches of the resulting finished seam. In the approach of the present invention, there is provided a preliminary basting station which receives a pair of aligned and abutting fabric members and preliminarily joins them together, preferably by applying a uniting row of basting stitches therebetween. Alternatively the basting seam might be formed by gluing or with other conventional joining means. The preliminarily joined pair of fabric members is then presented to a unique folding station which folds one fabric member beneath the united margins and folds the other fabric member to overlie the united margins as the fabric members are fed along the folding station. Subsequently, a final seaming station, preferably in the form of a multiple needle sewing machine, applies two or more rows of stitches longitudinally of the folded seam.

The folding apparatus may be an integral part of a machine incorporating both zig-zag and multiple needle heads axially aligned with one another. Alternatively, the folder may be provided with its own table as an independent piece of apparatus which is interposed in alignment between the sewing tables of the zig-zag and multiple needle machine. For for further versatility, material may be fed through a zig-zag machine (or other means of joining) at one station to provide the preliminarily basted seam which, at a later time, can be fed through the novel folding apparatus and a multiple needle machine at another sewing station to make the final lap seams.

The folding apparatus itself lies at the heart of the invention and includes a base plate having a guide rib or scroll extending generally upwardly therefrom and a generally horizontal guide plate spaced above the surface of the base plate a distance at least as great as the thickness of one of the fabric members. The guide plate includes a longitudinal edge which extends substantially the entire length of the base plate along a feed path substantially parallel with a line formed by the abutting edges of the fabric members, and forms the aforesaid line around which the underlying fabric member is folded. The guide rib or scroll is positioned adjacent the longitudinal edge of the guide plate and includes a first upstanding curved edge that is so constructed as to lift the united margins and the eventual overlying fabric member up and around the longitudinal edge of the guide plate while holding the eventual underlying fabric member therebeneath. A second upstanding curved edge downstream of the first curved edge forms the line about which the overlying fabric member is reverse folded to overlie the united margins.

It is therefore an object of the present invention to provide an apparatus and technique for forming simulated felled seams in an automatic, continuous operation.

It is another object of the present invention to provide an apparatus and technique for forming seams of the type described in which the preliminary butt seam formed by the abutting edges of the two fabric members is maintained centrally within the confines of the resulting felled seam.

A further object of the present invention is to provide an apparatus and technique of the type described in which the preliminary butt seam formed by the abutting edges of the adjacent fabric members is positively engaged by a guide edge throughout the majority of the folding operation to ensure that it is maintained centrally between the confines of the eventual felled seam.

Other objects and a fuller understanding of the invention will become apparent from reading the following description of a preferred embodiment along with the accompanying drawings in which.

DETAILED DESCRIPTION OF A PREFERRED EMBODIMENT

Figure 5:
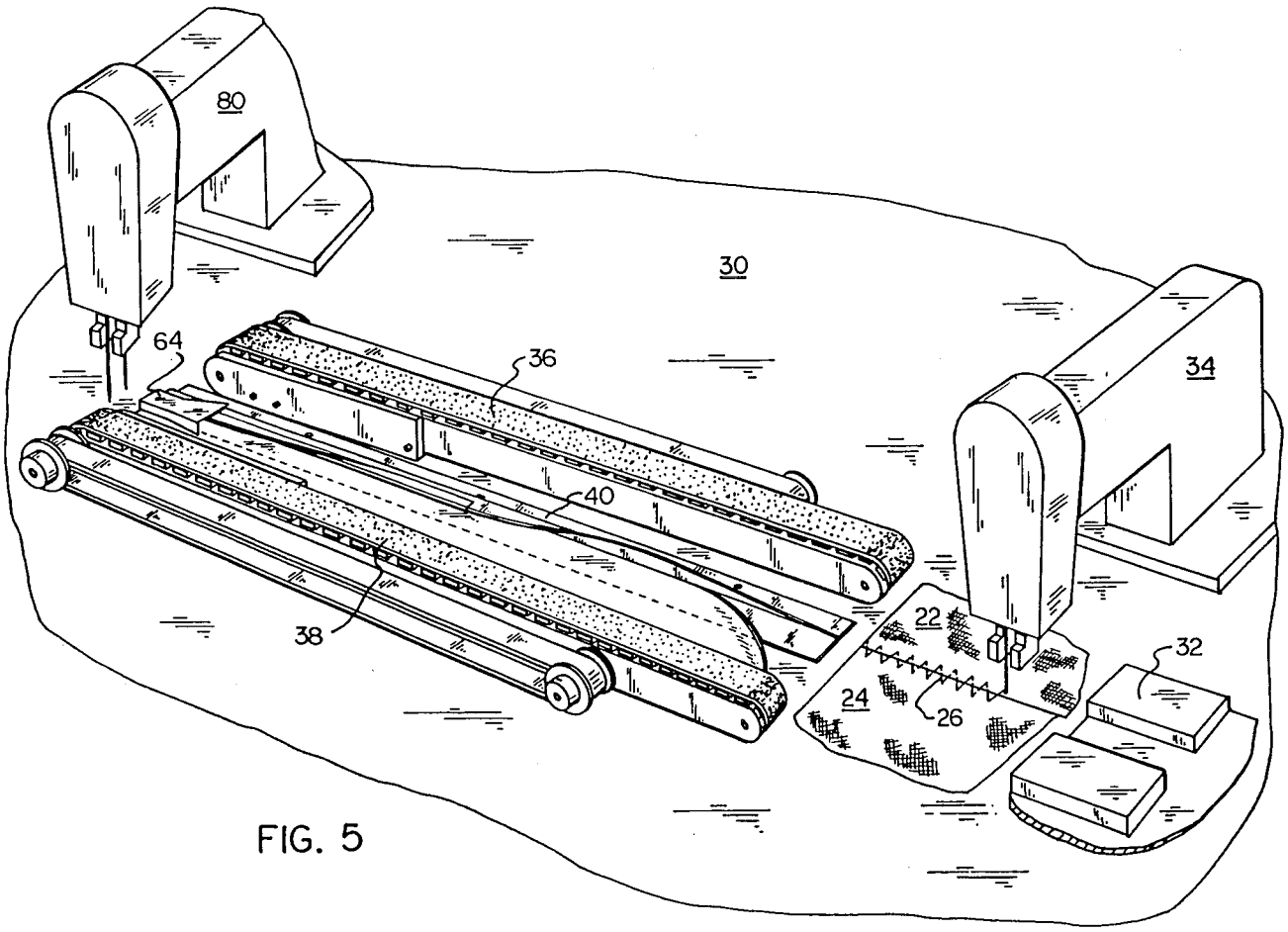
FIG. 5 is a perspective view, with parts broken away, illustrating the apparatus utilized in the formation of the simulated felled seam.

As previously discussed, the novel folder device 40 may be used separately from the basting head and the final seaming apparatus and is not necessarily mounted in aligned arrangement therebetween as illustrated in FIG. 5, however, the arrangement illustrated in FIG. 5 is the preferred embodiment and thus will be utilized in the present description.

Figure 1:
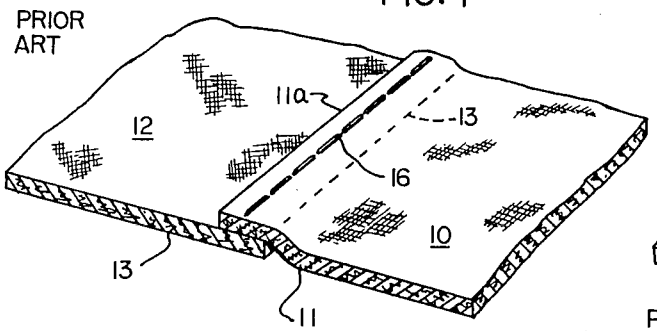
FIG. 1 is a perspective view, with parts broken away, illustrating a pair of fabric members overlapped in preparation for the formation of the conventional felled seam.
Figure 2:
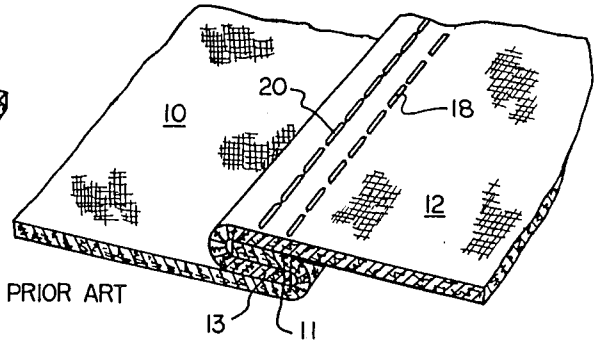
FIG. 2 is a perspective view, with parts broken away, similar to FIG. 1, except showing the fabric members formed into the conventional felled seam.

Referring now to the drawings there is illustrated in FIGS. 1 and 2 a conventional felled seam as discussed hereinabove. In the formation of a conventional felled seam, a pair of fabric members 10,12 are arranged in overlapping relation in such a manner that the proximate margin 11 of member 10 overlaps the proximate marginal area 13 of the other fabric member 12. The edges 11*a*,13*a* form lines about which fabric member 10 and 12 will subsequently be folded to form the felled seam. Basting seam may be applied although it is not necessary in the conventional felled seam. As illustrated in FIG. 2, the major portion of fabric member 10 is then folded around the edge 13*a* of fabric member 11 to underlie marginal portions 11,13. Also the other fabric member 12 is folded around the edge 11*a* of fabric member 10 to overlie the proximate marginal edges 11,13. A pair of parallel lines of finished stitches 18,20 then secure the felled seam together. As illustrated in FIG. 2, such seams have four plies, and as described hereinabove are relatively bulky and more expensive because of the added fabric.

Figure 3:
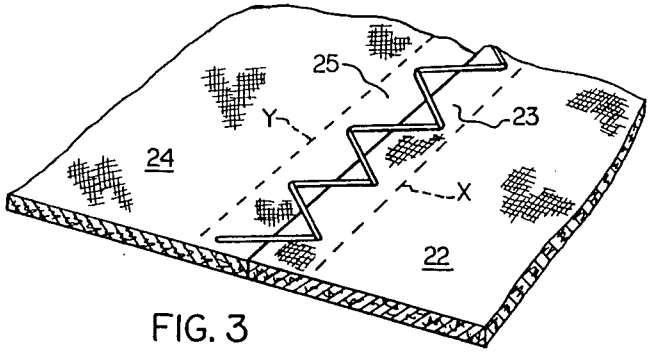
FIG. 3 is a perspective view, with parts broken away, illustrating a pair of fabric members in abutting relationship in preparation for the formation of a modified or simulated felled seam in accordance with the techniques of the present invention.
Figure 4:
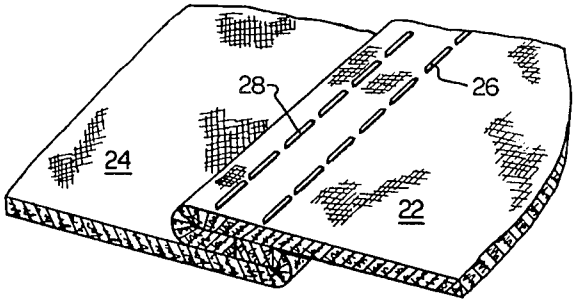
FIG. 4 is a perspective view, with parts broken away, illustrating the simulated felled seam, as formed in accordance with the present invention.

In FIGS. 3 and 4, there is illustrated the simulated felled seam, the formation of which is the subject of the present invention. In the simulated felled seam, the proximate marginal edges 23,25 of a pair of fabric members 22,24 are not overlapped, but are abutted and provided with a preliminary basting seam 26. Then, as illustrated in FIG. 4, the marginal areas 23,25 and the right hand member 22 are folded about imaginary line y to overlie the major portion of the other fabric member 24. The major portion of the first fabric member 22 is then reverse folded about imaginary line x to overlie the marginal portions 23,25. A pair of parallel rows of stitches 26,28 is then applied to finish the simulated felled seam as illustrated in FIG. 4. Alternatively, the parallel rows of stitches 26,28 could be replaced by three or more parallel rows of stitches, by one or more rows of zig-zag stitches, or by any other decorative finishing seam. The important thing is that the simulated felled seam contains only three plies of fabric, is less bulky, looks neater, is just as strong, and results in a saving of fabric because of the elimination of one fabric ply.

Turning now to a description of the apparatus, there is provided a work table 30 having a planar upper surface onto which the various apparatuses are mounted. In accordance with the present invention, in general, there is provided an alignment device 32, a basting means 34, a feed means 36,38 which feeds the temporarily joined fabric members 22,24 through a folding apparatus 40, and a double headed seaming apparatus 80 which applies a pair of parallel rows of finished stitches 26,28. The aligning means 32 may be some type of mechanical aligning mechanism, or may be performed manually. It is only important to the present invention that the two fabric members 22,24 are aligned in some method so that the adjacent edges abut. The basting mechanism 34 is preferably a single head sewing machine which applies a zig-zag basting stitch 26 to the aligned and abutted fabric members 22,24 thereby preliminarily seaming them together. The joined fabric members are then fed through the folding apparatus 40. In order to properly provide slack in the fabric as hereinafter described, feed belts 36,38 converge slightly in the downstream direction. At the other end the double row of seaming stitches is applied by the double needle sewing machine 80. The feed means 36,38 may be of any conventional type. The folding apparatus 40 and technique utilized to fold the fabric members 22,24 into the simulated felled seam lies at the heart of the present invention.

Figure 6:
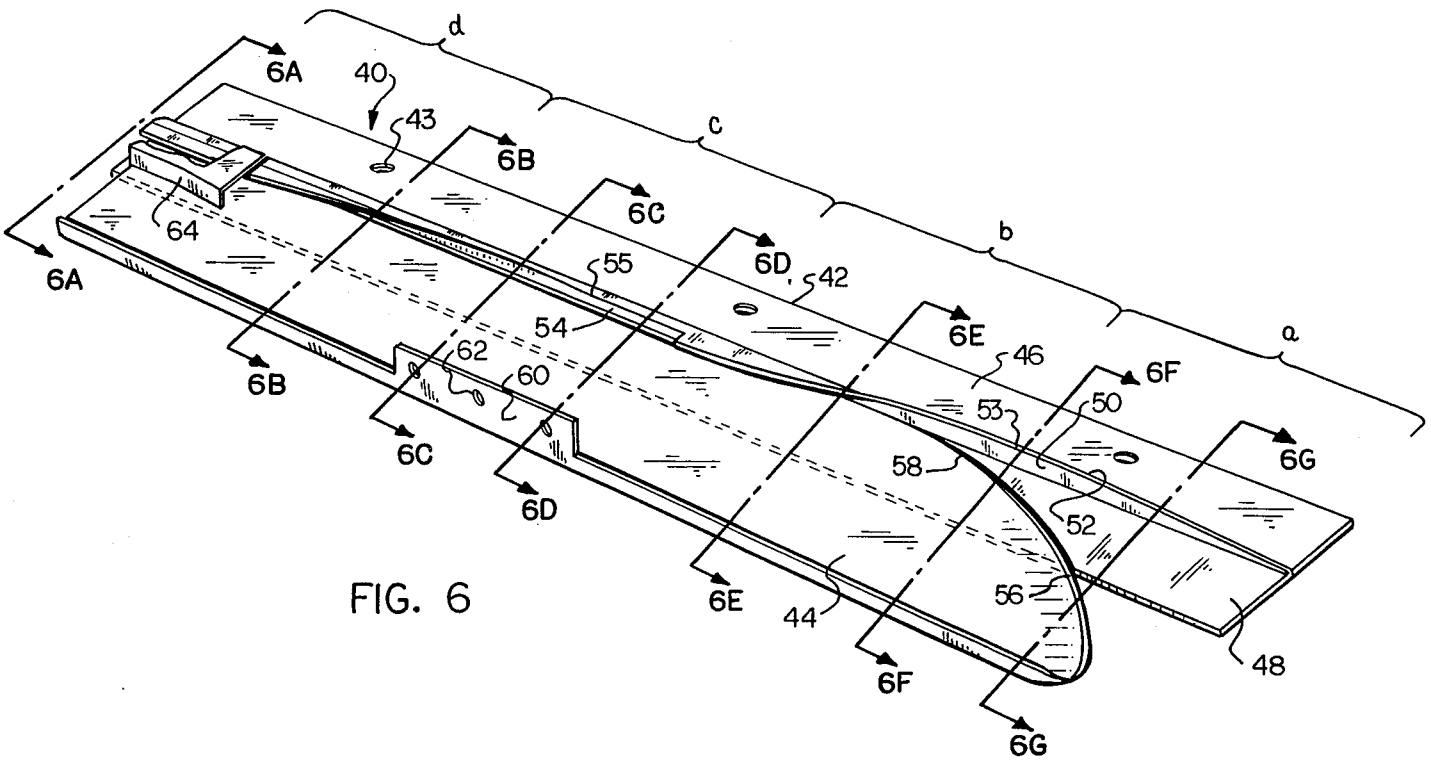
FIG. 6 is a perspective view of the unique folding apparatus utilized in the present invention; and FIGS. *6a–6g* are sectional views taken substantially along lines *6a–6g* respectively in FIG. 6.

Turning now to FIG. 6, there is illustrated the folding apparatus 40 of the present invention which, in general, is formed of two components, i.e. a base plate 42 and a guide plate 44 which are cooperatively arranged to manipulate the fabric members 22,24 into the configuration illustrated in FIG. 4. The base plate 42 is itself formed of two substantially abutting plate members 46,48 which may be joined by an appropriate welding technique on the underside thereof. The marginal portion of plate member 48 which is adjacent plate 46 extends upwardly from the plane formed by plates 46,48 as best illustrated in FIGS. *6e–6g*. The aforesaid upwardly extending marginal portion forms a rib or scroll 50 which includes an upper edge 52 which receives and guides the preliminary butt seam of fabric members 22,24 thereover and guides this preliminary seam through the folding apparatus 40. It is this edge 52 and the path it follows that maintains the preliminary seam centrally located within the confines of the felled seam as it is formed.

For purposes of discussion, one should imagine the folding apparatus being divided into four sections a–d approximately equal in length. Looking at the first one-quarter section a of the length of the folding apparatus 40, the upper edge 52 of the vertical rib 50 inclines upwardly beginning at the upstream end of base plate 42 to its uppermost point 53. This point 53 is spaced above the surface of plate members 46,48 a distance such that when the proximate margins 23,25 and upper member 22 are subsequently folded around line y (FIG. 3) as best shown in FIG. 4, the preliminary butt seam will lie approximately in the center of the ensuing felled seam.

Looking now at the second portion b of the length of folding apparatus 40, the upper edge 52 curves in a convolute path to a position in which the rib 50 is bent folded over until it extends substantially parallel with the surface of plate 48 at a distance thereabove slightly greater than twice the thickness of the fabric member 24 (to accommodate two thicknesses of fabric, plate 44, and some clearance). (See FIG. 6*d*). In the third portion c of the folding apparatus 40, a second rib 54 is attached to the upper surface of rib 50. The rib 54 is attached along one edge thereof to the edge 52 of rib 50 and further includes a second longitudinal edge 55 which is bent in a convolute path from a position lying flat against the upper surface of rib 50 to an upstanding position (FIG. 6*b*). In the last one quarter of the length of folding apparatus 40, the edge 55 of uppermost rib 54 continues its convolute path outwardly to a point where it is parallel to the surface of plate 48 (FIG. 6*a*). Edge 55 at this point then forms the imaginary line x about which the major portion of fabric member 22 is reverse folded to overlie marginal portions 23,25. The seam then enters a guide trumpet 64 (which can be omitted if desired) which holds the seam securely together until it is introduced to the double headed sewing machine 80, whereupon the final rows of stitches are applied.

The guide plate 44 may include an upstanding mounting flange 60 along one longitudinal edge thereof having a plurality of mounting holes 62 therein for securing the guide plate 44 to table 30 or feed device 38. The guide plate 44 is so constructed as to extend above and substantially parallel with plate member 48 with an intervening spacing therebetween slightly greater than the thickness of a fabric member 22 being fed therethrough. The distance should be great enough so that the fabric member does not bind, and yet small enough so that adequate control of the fabric member is maintained. A beveled leading edge 56 of guide plate 44 guides the fabric therebeneath. A longitudinal edge 58 of guide plate 44 extends parallel to the left drive belt 38 and thus to the path of movement of the fabric members 22,24 through the folding apparatus 40. It is this longitudinal edge which forms the line y about which the first fold is made and maintains engagement with this fold at a prescribed point with relation to the continuously convoluting edge 52 and 55. It is the combination of the longitudinal edge 58, the convoluting edge 52 of rib 50, and the convoluting edge 55 of the second rib 54 which cooperate to maintain the preliminary butt seam centrally located within the simulated felled seam throughout the formation thereof.

Turning now to FIGS. 6*a*–6*g* there is best illustrated the formation of the simulated felled seam as the fabric members 22,24 are processed through the folding apparatus 40. FIGS. 6*a*–6*g* are actually in reverse order with respect to the movement of fabric, so in order to facilitate an understanding of the process, the description begins at FIG. 6*g*.

As the folding operation proceeds, the basted fabric members 22,24 are presented to the folding apparatus 40. As best illustrated in FIG. 6*g*, rib 50 begins to slope out of the planar surface formed by plates 46,48 to lift the preliminary butt seam. As the fabric members proceed along the folding apparatus 40, sufficient slack is developed in the fabric by the convergence of the drive belts 36,38. Moving to FIG. 6*f*, rib 50 has now inclined to full height, and the marginal portion 25 has been formed perpendicular to fabric member 24. In FIGS. 6*e* and 6*d*, the marginal portion 25 is completely formed and laid back atop the fabric portion 24.

In FIG. 6*c*, the second rib 54 has been added and the second marginal portion 23 is being formed and lifted by the movement of the edge 55 of rib 54 in its convolute path (see FIG. 6*b*). Finally, in FIG. 6*a*, the fabric member 22 has been reverse folded back atop the abutting proximate marginal portions 23,25 and the simulated felled seam is completely formed and ready for the finish seaming operation.

It should be realized that during the formation, and as illustrated in FIGS. 6*a*–6*g*, the folder apparatus 40, as constructed and described with reference to FIG. 6 controls the movement of the fabric members therethrough and prevents sidewise slippage or translation, which could result in an unacceptable movement of the preliminary butt seam away from the center of the confines of the felled seam. The longitudinal edge 58 positively defines the line y, the upper edge 52 of rib 50 maintains the preliminary butt seam centrally located of the folded simulated felled seam, and the outer or upper edge 55 of rib 54 defines the opposite line x about which the upper fabric member 22 is folded.

While a preferred embodiment of the present invention has been described in detail hereinabove, it is apparent that various changes and modifications might be made without departing from the scope of the present invention which is set forth in the following claims.

What is claimed is:

1. Apparatus for folding and seaming a pair of fabric members into a finished three-ply construction in which said fabric members have proximate abutting margins, the adjacent edges of which are united by a row of basting stitches, and in which one of the fabric members is folded along a first imaginary line on one side of said row of basting stitches to underlie the united margins and the other of the fabric members is reverse folded along a second imaginary line on the other side of said row of basting stitches to overlie the united margins, and further in which the three-ply seam is subsequently stitched together, said apparatus comprising:

(a) a folding station having an upstream end and a downstream end;

(b) a first joining means adjacent the upstream end of said folding station for initially joining the abutting edges of said pair of fabric members to preliminarily hold them in abutting relationship during the folding operation;

(c) a second seaming means adjacent the downstream end of said folding station for permanently joining all three plies;

(d) feed means for transporting said basted pair of fabric members from said first seaming means to said second seaming means through said folding station along a feed path substantially parallel with the line formed by said abutting edges;

(e) said folding station comprising:

(i) a base plate having a guide rib or scroll extending upwardly therefrom and a guide plate spaced above said base plate a distance at least as great as the thickness of the fabric member being processed;

(ii) said guide plate including a longitudinal edge thereof extending lengthwise of said folding station and forming the aforesaid first imaginary line around which said underlying fabric member is folded;

(iii) said guide rib being positioned adjacent said longitudinal edge of said guide plate and having a first upstanding curved edge means that is so constructed as to extend in a convolute path as to lift the united margins and the overlying fabric member up and around the longitudinal edge of said guide plate, and a second guide rib having a second upstanding curved edge downstream of said first curved edge that extends in a convolute path and forms said second imaginary line around which said overlying fabric member is reverse folded to overlie the united margins.

2. The apparatus according to claim 1 in which said first upstanding edge slopes upwardly in a downstream direction throughout a first portion of said guide rib, said first upstanding edge in a second portion is then bent over in a curved path until said rib is substantially parallel to the surface of said base plate and serving to position the abutting edges of said first and second member centrally of the eventual folded seam, a second guide rib in a third portion being attached to said first guide rib and including a second edge commencing at a point adjacent the upper surface of the first guide rib and curving upwardly throughout said convolute path to a point substantially perpendicular to the surface of said second guide rib for defining said second imaginary line, said second curved edge in a fourth portion then curving in a convolute path coplanar with the parallel portion of said first guide rib to establish said longitudinal edge about which said other fabric member is reverse folded.

3. The apparatus according to claim 2 wherein the upstanding wall of said guide rib and said longitudinal edge of said guide plate are separated by a distance approximately equal the thickness of the fabric being processed, whereby said folded seam is prevented from lateral movement as it is fed through the folding apparatus.

4. A device for folding a pair of abutting fabric members having proximately abutting margins, the adjacent edges of which are united, into a folded, three-ply construction in preparation for a finished seaming operation in which one of the fabric members is folded along a first imaginary line on one side of the abutting edges to underlie the abutting margins and the other of the fabric members is reverse folded along a second imaginary line on the other side of said row of said basting stitches to overlie the abutting margins, said device comprising:

(a) a base plate having a guide rib extending generally upwardly therefrom and a generally horizontal guide plate spaced above the surface of said base plate a distance at least as great as the thickness of one of said fabric members;

(b) said guide plate including one longitudinal edge extending lengthwise of said base plate along a feed path generally parallel with a line formed by the abutting edges of said fabric members, said guide plate edge forming the aforesaid first imaginary line about which said underlying fabric member is folded;

(c) said guide rib being positioned adjacent said longitudinal edge of said guide plate and having a first upstanding curved edge that is so constructed in a convolute path as to lift the united margins and the overlying fabric member up and around the longitudinal edge of said guide plate and a second guide rib having a second upstanding curved edge downstream of said first curved edge that is also constructed in a convolute path that forms said second imaginary line around which said overlying fabric member is reverse folded to overlie the united margins.

5. The apparatus according to claim 4 in which said first upstanding edge slopes upwardly in a downstream direction throughout a first portion of said guide rib, said first upstanding edge in a second portion is then bent over in a curved path until said rib is substantially parallel to the surface of said base plate and serving to position the abutting edges of said first and second member centrally of the eventual folded seam, a second guide rib in a third portion being attached to said first guide rib and including a second edge commencing at a point adjacent the upper surface of the first guide rib and curving upwardly throughout said convolute path to a point substantially perpendicular to the surface of said second guide rib for defining said second imaginary line, said second curved edge in a fourth portion then curving in a convolute path coplanar with the parallel portion of said first guide rib to establish said longitudinal edge about which said other fabric member is reverse folded.

6. The apparatus according to claim 4 wherein the upstanding wall of said guide rib and said longitudinal edge of said guide plate are separated by a distance approximately equal the thickness of the fabric being processed, whereby said folded seam is prevented from lateral movement as it is fed through the folding apparatus.

* * * * *